US006720887B1

(12) United States Patent
Zunti

(10) Patent No.: US 6,720,887 B1
(45) Date of Patent: Apr. 13, 2004

(54) FLEXIBLE, RECONFIGURABLE WIRELESS SENSOR SYSTEM

(76) Inventor: James Michael Zunti, 404 48th Avenue Southwest, Calgary, Alberta (CA), T2S 1E2

( * ) Notice: Subject to any disclaimer, the term of this patent is extended or adjusted under 35 U.S.C. 154(b) by 513 days.

(21) Appl. No.: 09/640,658

(22) Filed: Aug. 18, 2000

(51) Int. Cl.[7] ..... G08C 19/12

(52) U.S. Cl. ..... 340/870.28; 340/573.1; 128/903; 600/301

(58) Field of Search ..... 340/870.28, 870.07, 340/573.1; 128/903, 904; 600/301

(56) References Cited

U.S. PATENT DOCUMENTS

| | | | | |
|---|---|---|---|---|
| 4,455,453 | A | 6/1984 | Parasekvakos et al. | |
| 5,200,743 | A | 4/1993 | St. Martin et al. | |
| 5,687,175 | A | 11/1997 | Rochester, Jr. et al. | |
| 5,959,529 | A | 9/1999 | Kail, IV | |
| 6,396,416 | B1 * | 5/2002 | Kuusela et al. | 340/870.28 |

FOREIGN PATENT DOCUMENTS

| | | | |
|---|---|---|---|
| FR | 2 710 438 | * | 3/1995 |

* cited by examiner

*Primary Examiner*—Timothy Edwards

(57) ABSTRACT

The present invention features a wireless, remote monitor system for multiple, diverse sensors. A remote transceiver is equipped with one or more interchangeable sensors, each type of sensor being capable of providing a unique identity code to the base monitoring station. Multiple sensors may be piggybacked so as to monitor more than one condition substantially simultaneously. The inventive system includes routines which automatically recognize the sensors and then upload and execute one or more sensor-specific software routines. This quasi "plug and play" approach overcomes problems where improper sensor inputs are made to a particular data analysis routine resulting in erroneous results. The inventive system is applicable to a wide variety of fields such as biomedical, athletics, security, etc. Each remote sensor included provisions for signal conditioning and data analysis. In addition, storage is provided at each remote mobile unit so that, in the event that the RF link is unavailable, the sensor data may be stored for later transmission once the communication link is reestablished.

16 Claims, 8 Drawing Sheets

FLEXIBLE, RECONFIGURABLE WIRELESS SENSOR SYSTEM

BACKGROUND OF THE INVENTION

1. Field of the Invention

The present invention relates to wireless sensors. More particularly, the invention comprises a reconfigurable wireless sensor system for use with multiple, interchangeable sensors.

2. Description of the Prior Art

For many years, the need to remotely monitor the status of an electrical/mechanical system, an animal, or a human being has been recognized. Under some circumstances, such as when the person or thing to be monitored is stationary, data may be communicated by means of a hard connection such as a telephone line, dedicated line, fibre channel, or the like. Often, however, the device, animal, or person to be monitored is mobile and the use of such a hard connection is impossible. For this reason, the field of wireless telemetry has developed. By using a radio frequency (RF) link, one-way or, sometimes, two-way data links can be established between a base monitoring/controlling station and a remote mobile unit supporting a remote sensor.

One such hard wired system is described in U.S. Pat. No. 4,455,453, issued to Theodoros G. Parasekvakos, et al. on Jun. 19, 1984. PARASEKVAKOS, et al. utilize a telephone-based system wherein a remote meter (e.g., a gas or electric utility meter) is selectively connected to a telephone line. The remote meter initiates a telephone call to a central complex at a predetermined time. The central complex initiates a hand shaking authentication routine after which, the remote meter transmits identification information along with its collected data. In addition, the central complex uploads the next call back time as well as any other required operating parameter change.

In contradistinction, the multi-sensor, reconfigurable system of the present invention utilizes an RF link, not a telephone connection. A multiplicity of interchangeable sensors are usable with the inventive system unlike the single, dedicated sensor of PARASEKAVOKOS, et al. Multiple, diverse sensors may be piggybacked in the inventive system. The inventive system also includes data storage capability to save monitored data during any lapse in the RF communications link.

Another hard wired system is taught in U.S. Pat. No. 5,200,743, issued Apr. 6, 1993 to Michael J. St. Martin, et al. St. MARTIN, et al. utilize a four-wire communications like to which multiple remote mobile units are connected, each station having a transducer. One pair of the four-wire system is used to communicate individually with the remote mobile units while the second pair is used to receive data from the stations. Each station may be individually addressed by the host and, upon command, each remote mobile unit transmits real-time, analog data to the host.

The inventive multi-sensor, reconfigurable system however, utilizes an RF link, and, unlike St. MARTIN, et al., may have reconfigurable, interchangeable sensor combinations. Each sensor identifies itself to the base station so that appropriate signal conditioning or signal processing and/or data reduction algorithms may be used. The multiple, piggybacked remote sensors of the inventive system utilize backup memory to store data while the data transceiver is, for example, out-of-range with the base station.

U.S. Pat. No. 5,687,175, issued Nov. 11, 1997 to Virgil Maurice Rochester, Jr., et al. teaches an adaptive, time-division multiplexing communication protocol for collecting data from remote sensors equipped with RF transceivers. All remote units "listen" for a command from the host, upon which they transmit a unique ID. These unique IDs are used by the host to individually poll each remote unit. When polled, each remote unit a packet of data. Upon receipt of the data packet from the remote unit, the host transmits an acknowledgement packet indicating that the data has been received. Upon receipt of the acknowledgement from the host, the remote unit is set to a stand-by state whereby it will not respond to the host for a predetermined length of time.

The inventive sensor system uses a packet transmission system for essentially continuous communication between a remote transceiver with its multiple, reconfigurable, self-identifying sensors and a base station. No command from the base host station is required to initiate periodic communication between the remote sensors and the base. Each type of sensor connected to the remote unit uniquely identifies itself to the base station and multiple, diverse sensor types may coexist on the same remote unit.

U.S. Pat. No. 5,959,529, issued Sep. 28, 1999 to Karl A. Kail, IV teaches another system for monitoring remote sensors. KAIL's sensors are carried or worn by a person or animal to be monitored or affixed to an inanimate object. Unlike the inventive system, the KAIL system teaches dedicated, non-interchangeable sensors having a single function, (i.e., to track the location of the person, animal or object to which the remote sensor is attached). The sensors of the inventive system may be varied and may also be piggybacked to allow monitoring more than one condition, substantially simultaneously. KAIL provides no teaching of any backup memory to store data when the remote sensor is out-of-range. Such backup memory is present in the remote sensor system of the instant invention so that data may be stored for later transmission when the communications link is unavailable.

In each one of these prior art inventions, some aspect of remote monitoring is taught, either utilizing a hard (i.e., wired) connection or an RF link. Unlike the prior art, the inventive system supports multiple remote mobile units on the same system, each remote mobile unit being capable of supporting multiple, diverse sensors.

None of the above inventions and patents, taken either singly or in combination, is seen to describe or render obvious the instant invention as claimed.

SUMMARY OF THE INVENTION

The present invention features a remote monitor system for a plurality of sensors. A remote mobile unit is equipped with one or more interchangeable sensors, each sensor being capable of providing a unique identity code to the base monitoring station. Multiple sensors may be piggybacked to simultaneously monitor more than one condition or parameter. The inventive system includes routines which automatically recognize each sensor type and invokes specific software routines applicable only to the sensors. This quasi "plug and play" approach overcomes problems where improper sensor inputs are made to a particular data analysis routine which often results in apparent sensor data errors. The inventive system is applicable to a wide variety of fields such as biomedical, athletics, security, etc. Each remote mobile unit has provision for both signal conditioning and data processing (i.e., data analysis, data reduction, etc.). In addition, storage is provided at each remote mobile unit so that, in the event that the RF link is unavailable, the sensor data may be stored for later transmission once the RF link is reestablished. In that event that data is being collected at a rate faster than it can be transmitted (i.e., a burst rate), the data may also be stored and transmitted at the slower data link rate.

Accordingly, it is a principal object of the invention to provide a wireless remote sensing apparatus.

It is another object of the invention to provide a wireless remote sensing apparatus which may accommodate a variety of diverse, interchangeable sensors.

It is a further object of the invention to provide a wireless remote sensing apparatus incorporating built-in signal conditioning and signal processing.

Still another object of the invention is to provide a wireless remote sensing apparatus having built-in storage which accumulates data during times when an RF link is unavailable to transmit data to a base station.

It is yet another object of the invention to provide data storage to buffer data being collected at a rate faster than the data can be transmitted to a base station.

An additional object of the invention is to provide a wireless remote sensing apparatus having automatic recognition of the sensor mix present.

It is again an object of the invention to provide a wireless remote sensing apparatus wherein a base station can upload appropriate software modules to the remote based upon the detected mix of sensors.

Yet another object of the invention is to provide a wireless remote sensing apparatus having remote programmability.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
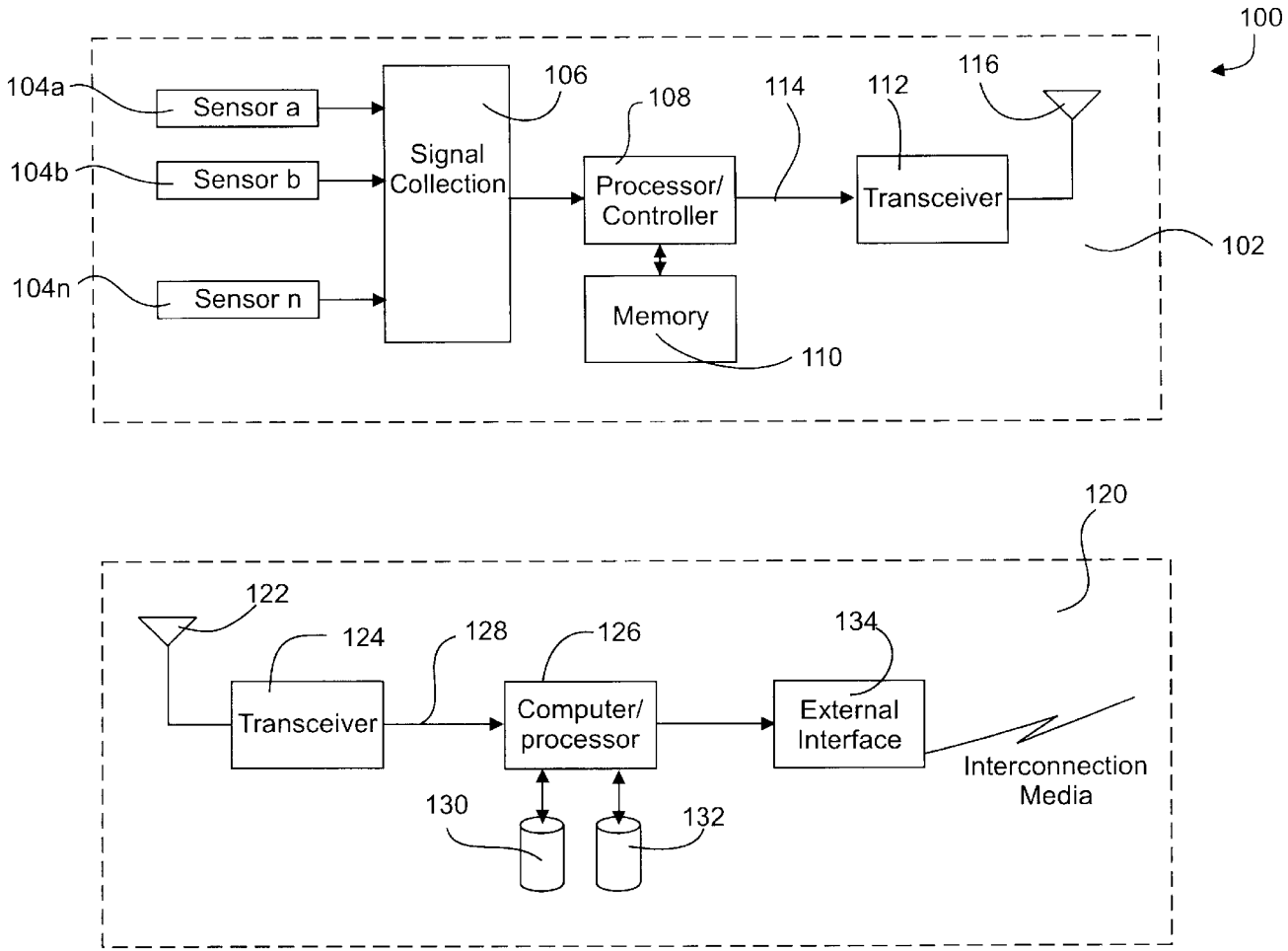
FIG. 1 is an overall system block diagram of the remote, mobile sensor system of the invention.

The present invention features a remote, mobile, programmable monitor system supporting a plurality of diverse sensors. Referring first to FIG. 1, there is shown an overall block diagram of the inventive system, generally at reference number 100. A remote mobile unit 102 consists of a number of sensors 104*a*, 104*b* 104*n* connected to the inputs of a signal collection device 106, typically an analog-to-digital (A/D) converter in conjunction with a multiplexor (MUX). The output of signal collection device 106 is connected to an appropriate input port of a processor/controller 108. A memory module 110 is connected to processor/controller 108. Processor/controller 108 is connected to a transceiver 112 by means of a two-way interface 114. An antenna 116 is connected to a radio frequency (RF) input/output connection on transceiver 112.

A base station 120 consists of an antenna 122 connected to an RF input/output port of a transceiver 124. Transceiver 124 is connected to a computer/processor 126 by means of a two-way interface 128. Also connected to computer/processor 126 are mass storage device 130 adapted to store data and mass storage device 132 where a library of software routines is stored. Computer/processor 126 is equipped with an interface designed to allow connection to a variety of external connections (not shown). Some possible connections include dial-up telephone, leased line, private RF or microwave link or the Internet. It will be obvious to those skilled in the data communications art that other possible communications strategies and transport mechanisms could also be used.

Figure 2:
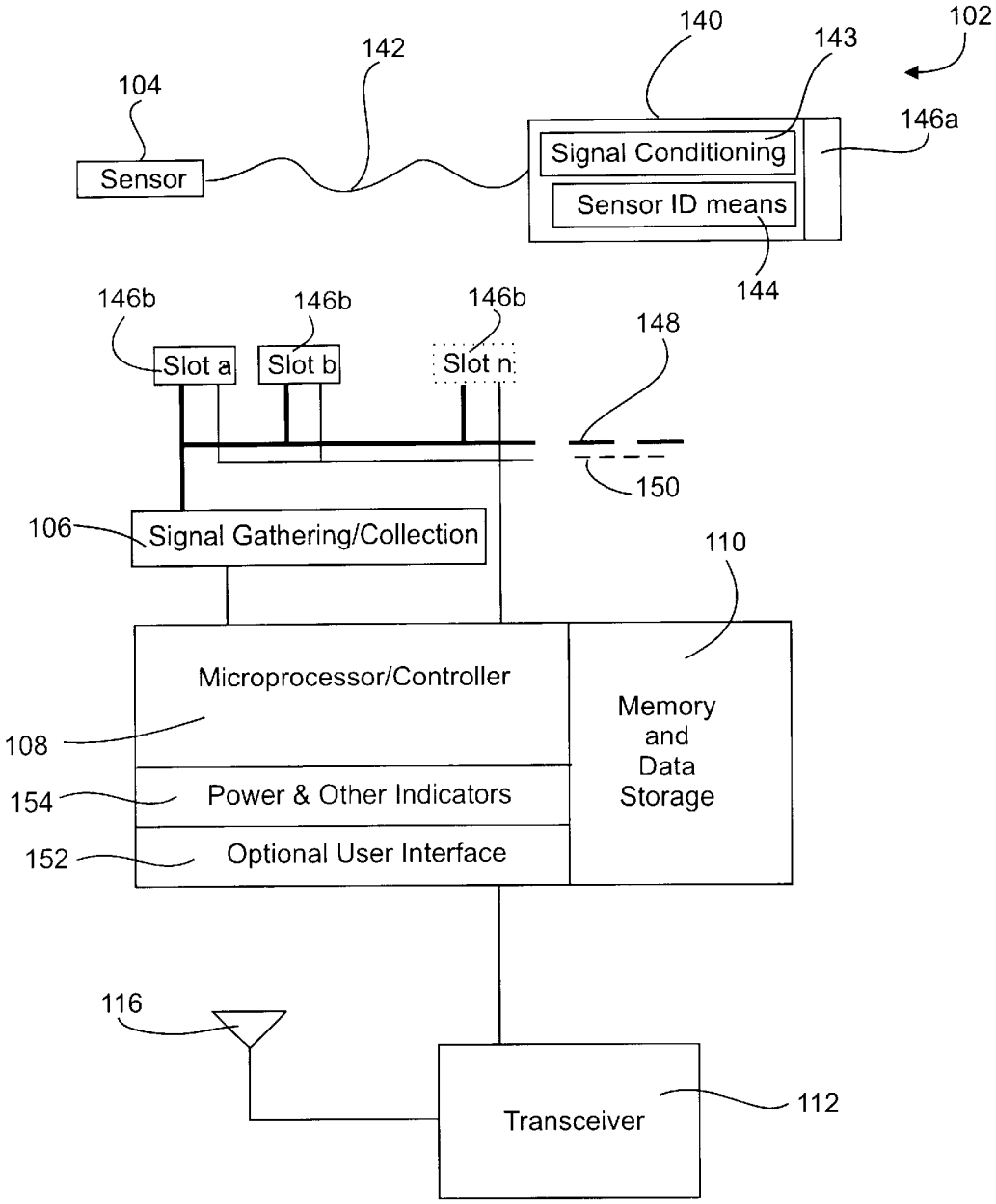
FIG. 2 is a schematic block diagram of the remote portion of the system of FIG. 1.

Referring now to FIG. 2, there is shown a detailed schematic block diagram of a remote mobile unit 102. A sensor 104, representative of a plurality of different sensors of diverse types, is shown connected to a sensor interface module 140 via a sensor cable 142. Typical sensors such as Burdick EKG patient cables and sensing pads could be used for biomedical applications. A sensor Scientific Model CB08-502T has been found suitable for temperature measuring applications. A Matsushita Model WM-063X microphone may be used for acoustical noise measurement applications. Virtually any sensor may be adapted for use in the inventive system by using appropriate circuitry in sensor interface module 140.

The remote mobile unit 102 or the base station 120 are adapted to interrogate the sensor identification means 144 and perform a configuring operation responsive to a sensor identification retrieved therefrom.

Sensor interface module 140 contains signal conditioning circuitry 143 which is sensor-specific and designed to perform a combination of operations such as buffering, amplifying, attenuating, filtering, integrating, differentiating and level converting. Signal conditioning may be provided using any combination of electrical, electronic, mechanical, optical or other devices. These signal conditioning devices may be either active or passive. In the embodiment chosen for purposes of disclosure, the signal collection function 106 is performed using an analog-to-digital (A/D) converter and a multiplexor (mux). The output of signal conditioning circuitry 143 is a normalized analog signal in the 0–3.3 volt range. While 0–3.3 volts has been chosen for purposes of disclosure, it will be obvious to those skilled in the art that other voltage ranges or signal measurement methods could be chosen to meet other operating requirements or environments.

In addition to signal conditioning circuitry 143, sensor interface module 140 contains sensor identification means 144, typically a sensor ID chip. Each sensor identification means 144 is programmed with a code unique to the particular type of sensor 104 with which it is associated. All sensors of a particular type are given identical sensor ID codes. In the preferred embodiment, an EPROM such as Catalog No. NM24C02U manufactured by Fairchild Semiconductor has been used to perform the sensor ID function. These sensor ID codes can be stored in any of the many non-volatile memory devices well know to those skilled in the art. In alternate embodiments, volatile memory and a internal power source could also be used to store the sensor ID code. A standard connector 146*a* terminates each sensor interface module 140.

A plurality of sockets 146*b* are provided to accept connectors 146*a* from sensor interface modules 140. In a typical embodiment where signal collection device 106 consists of an analog-to-digital (A/D) converter and multiplexor, sockets 146*b* are connected to an analog signal bus 148 as well as a digital signal bus 150. Analog signal bus 148 is connected to the analog-to-digital (A/D) converter and multiplexor. In the embodiment chosen for purposes of disclosure, signal collection device 106 is a type ADC12L038 3.3 Volt Self Calibrating 12-bit Plus Sign Serial I/O A/D converter with MUX and Sample/hold provisions manufactured by National Semiconductor. It should be obvious that other commercially available A/D-MUX chips could also be used.

Signal collection device 106 is connected to a microprocessor/controller 108. Any of a wide variety of microprocessors ($\mu$Ps) or controllers well know to those skilled in the art may be used in the inventive system. Microprocessor/controller 108 is connected to digital signal bus 150. Memory 110 for data storage is also attached to microprocessor/controller 108. Microprocessor/controller 108 is also connected to a wireless data transceiver 112 which is connected to an antenna 116. Transceiver 112 is a commercial "radio" modem such as the Model 3090 Modem manufactured by Ericsson. The Ericsson 3090 combines microprocessor/controller 108 with transceiver 112 in a single compact package. Other manufacturers, such as Research in Motion (RIM), make similar equipment. A RIM model 902M has also been found suitable for use in the inventive application. In alternate embodiments, the functions of microprocessor/controller 108 and transceiver 112 could, of course, be performed by separate devices.

An optional user interface 152 and a indicator panel 154 having a power indicator and other such indicators as may perform useful functions in different embodiments of the inventive system.

In the preferred embodiment, the well-known Mobitex communications infrastructure has been used. Mobitex is a wireless data communications system developed in the early 1980s by Eritel for the Swedish Telecommunication Administration. It has become a defacto standard for applications such as the that of the instant invention. Mobitex networks are maintained in the United Stated by such communications providers as BellSouth Wireless Data. It should be obvious that other commercial or private, proprietary communications strategies could be used to perform the necessary data communications functions between remote, mobile unit 102 and a base station 120 (FIG. 1).

Refer now again to FIG. 1. In the embodiment chosen for purposes of disclosure, a base station 120 utilizes a commercial data transceiver such as Base Radio Unit Model BRU3 manufactured by Ericsson. The remainder of the components making up base station 120 are all commercially available and readily understood by those skilled in the art. One external interface found suitable for the application is a Mobitex Main/Area Exchange unit Model MX, also manufactured by Ericsson. The functions of base station 120 will be described in detail hereinbelow.

Figure 3:
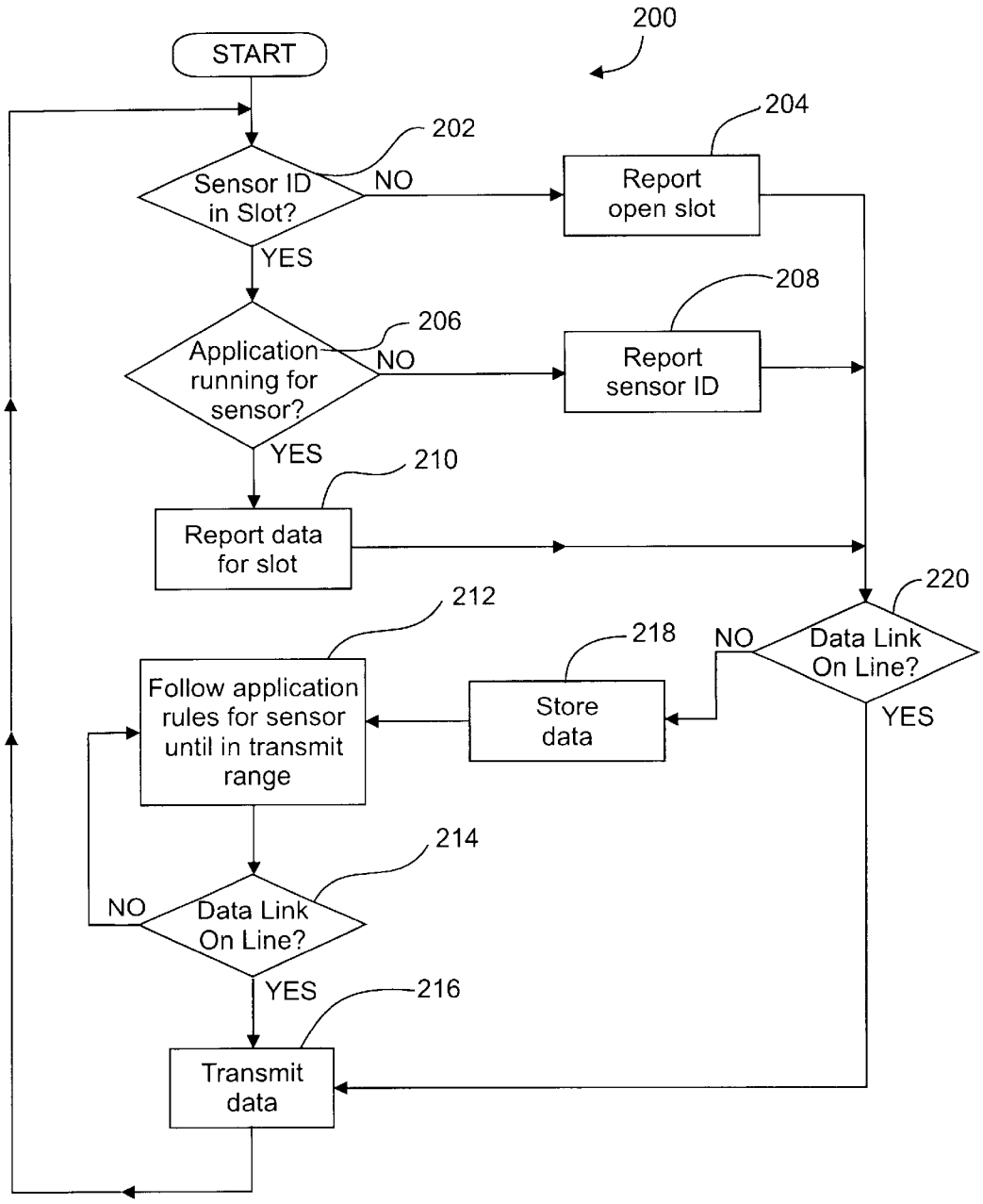
FIG. 3 is a flow chart of a remote mobile unit reporting to a base station.

Referring now to FIG. 3, there is shown a flowchart 200 showing the steps performed at a remote, mobile unit. It is assumed that multiple sensors 104 (FIG. 1) are in place. These sensors 104 are scanned in the sequence they are connected to connectors 146*b* (FIG. 2). For each slot (i.e., connectors 146*b*), the presence and ID of a sensor is checked, step 202. If no sensor is present, an "open slot" is reported, step 204. If the data link is available, step 220, the "open slot" report is transmitted, step 216. If the data link is not available, step 220, the "open slot" message is stored for later transmission, step 218. If a sensor is present, step 202, the system is checked to see if application software associated with the sensor is running, step 206. If no application software is running, the "sensor ID" is reported, step 208. If application software associated with the sensor is, however, running, the remote, mobile unit attempts to report the data for the sensor, step 210. If the data link is not available, step 220, the data is stored for later transmission, step 218. A set of rules associated with each sensor-specific application software is consulted, step 212. A check is again made to see if the data link is available, step 214. If the data link is available, step 214 (i.e., ready and the remote mobile unit is within radio range), the data is transmitted, step 216. If, however, the data link is not available (i.e., off line, out of radio range, etc.) step 214, control is again transferred to block 212. This process is repeated until all the slots have been queried and reported. It is possible for data to be collected by a particular sensor more quickly than the data link can transfer it. In this case, the data is stored, step 218, and transmitted, step 216, at rate slower than the data collection rate.

Figure 4:
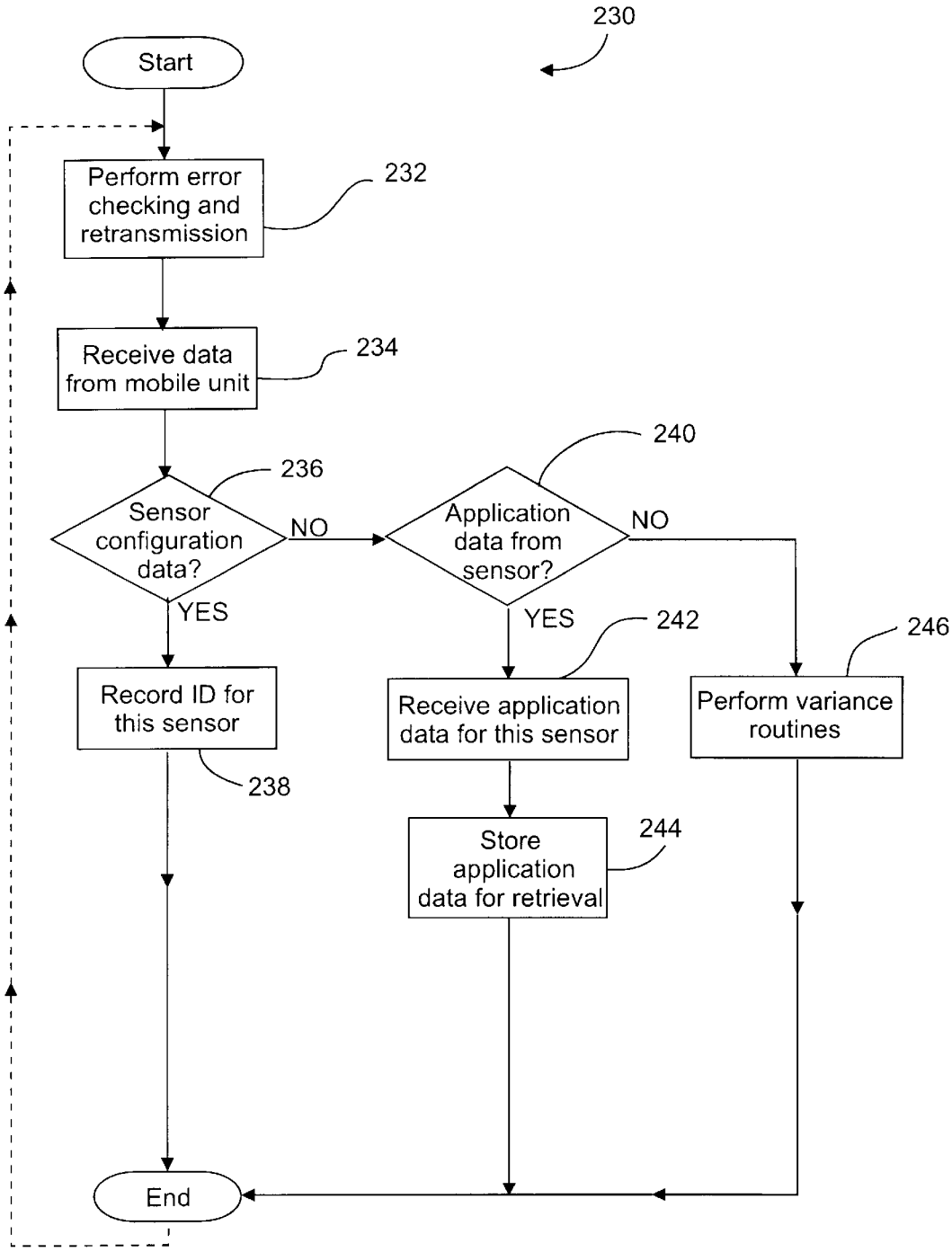
FIG. 4 is a flow chart of a base station gathering data from a remote mobile unit.

Referring now to FIG. 4, there is shown a flowchart 230 showing the steps performed at a base station 120 (FIG. 1) for receiving data from remote, mobile unit 102 (FIG. 1) in accordance with the instant invention. Error checking and retransmission requests are handled by the data transmission protocols within commercial data transceivers 112, 124 (FIG. 1), step 232. These routines are well know to those skilled in the data transmission arts and form no part of the present invention. Good data is received from the remote mobile unit 102, step 234. The data reception routines are performed for all sensor positions (i.e., slots") in the remote, mobile unit 102. If the received data is sensor configuration data, step 236, the sensor ID is recorded, step 238. If the data is not sensor configuration data, step 236, then the data is tested to see if it is application data, step 240. If the data is application data, it is accepted, step 242 and stored, step 244. If however, the data is not application data, step 240, appropriate variance routines are performed, step 246. The steps are repeated for the remaining sensor slots 146*b* (FIG. 2) which are processed in an identical manner.

Figure 5:
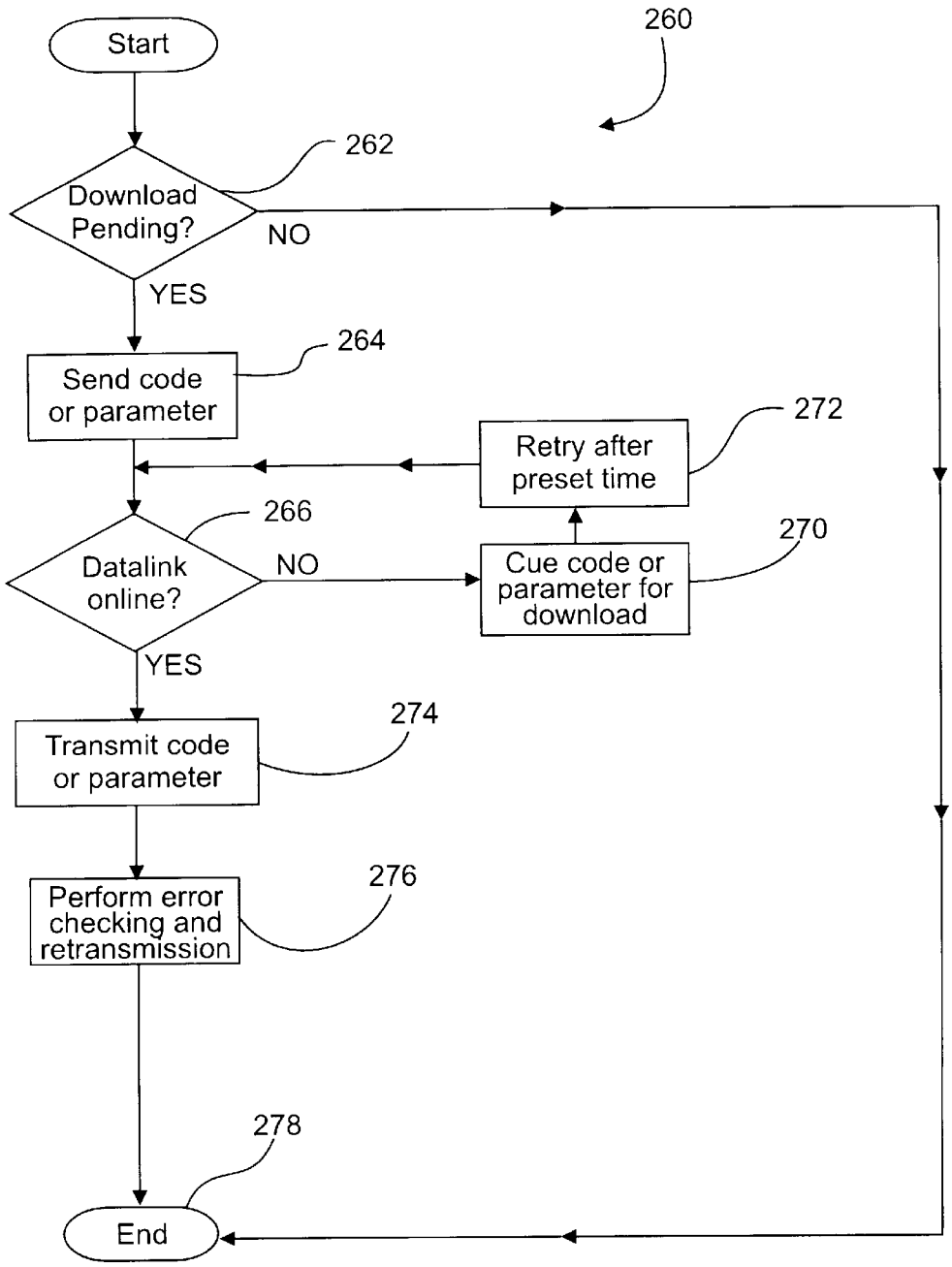
FIG. 5 is a flow chart of a base station uploading instructions to a remote mobile unit.

Referring now to FIG. 5, there is shown a flowchart 260 showing the steps required for a base station 120 (FIG. 1) to upload information to a remote mobile unit 102 (FIG. 1). For each defined sensor position on remote mobile unit 102, presence of information to be uploaded for the specified sensor is checked, step 262. If there is not pending information to be transmitted, the routine ends, step 278. If, however, information is pending, the information is sent, step, 264. If the datalink is available, step 266, the data is transmitted, step 274. Error checking routines are performed, step 276, and after the data transmission has been properly accomplished, the routine exits, step 278. If, however, the datalink is not available, step 266, the information to be transmitted is queued, step 270. After a programmed delay, step 272, the datalink's availability is again checked, step 266. This overall process 260 is repeated for all defined sensor positions at remote mobile unit 102.

Figure 6:
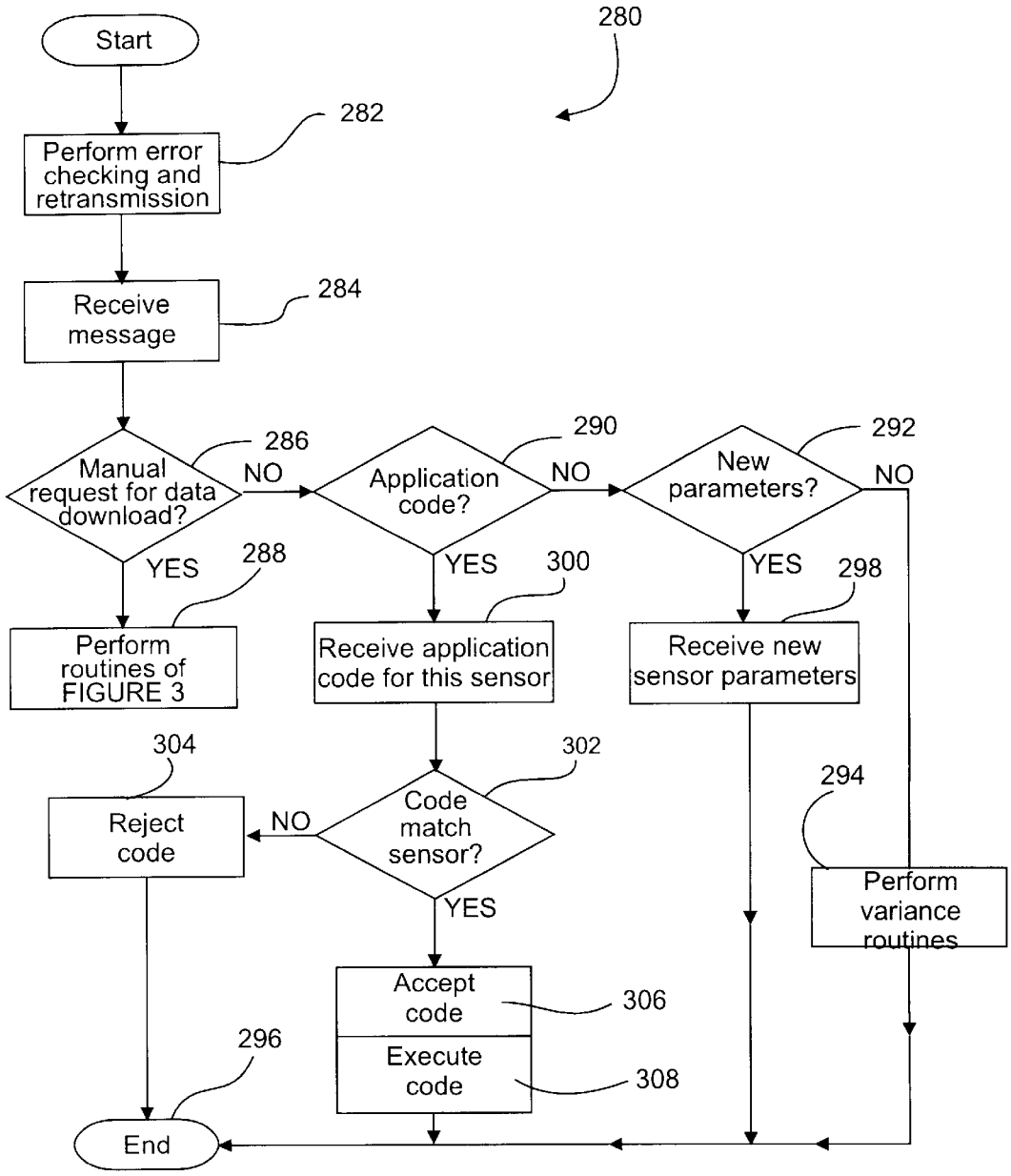
FIG. 6 is a flow chart of a remote mobile unit receiving a transmission from a base station.

Referring now to FIG. 6, there is shown a flowchart 280 showing the steps performed by remote mobile unit 102 in receiving an upload from base station 120. The incoming message is error-checked, step 282. Once the error checking is complete, a verified message is received, step 284. The message content is checked to determine if it contains a manual request for data download, step 286. If it is a manual data download request, the step of flowchart 200 (FIG. 3) are performed, step 288. If the message is not a manual data download request, step 286, the message is checked to see if it contains application code, step 290. If the message does not contain application code, it is checked to see if it contains new parameters for the particular sensor, step 292. If the message does not contain new sensor parameters, step 292, appropriate variance routines are performed, step 294, and the routine is completed, step 296. Referring again to block 290, if the message does contain application code for the specific sensor, step 290, the application code is received, step 300. The embedded sensor code information in the application code is checked against the sensor ID code, step 302. If the codes do not match, the application code is rejected, step 304 and the routine ends, step 296. If, however, the codes match, step 302, the application code is accepted, step 306 and the code is executed, step 308. The routine is then ended, step 296. Referring again to step 292, if the message does contain new sensor parameters, they are received, step 298, and the routine ends, step 296. This routine is repeated for each defined sensor at remote mobile unit 102.

Figure 7:
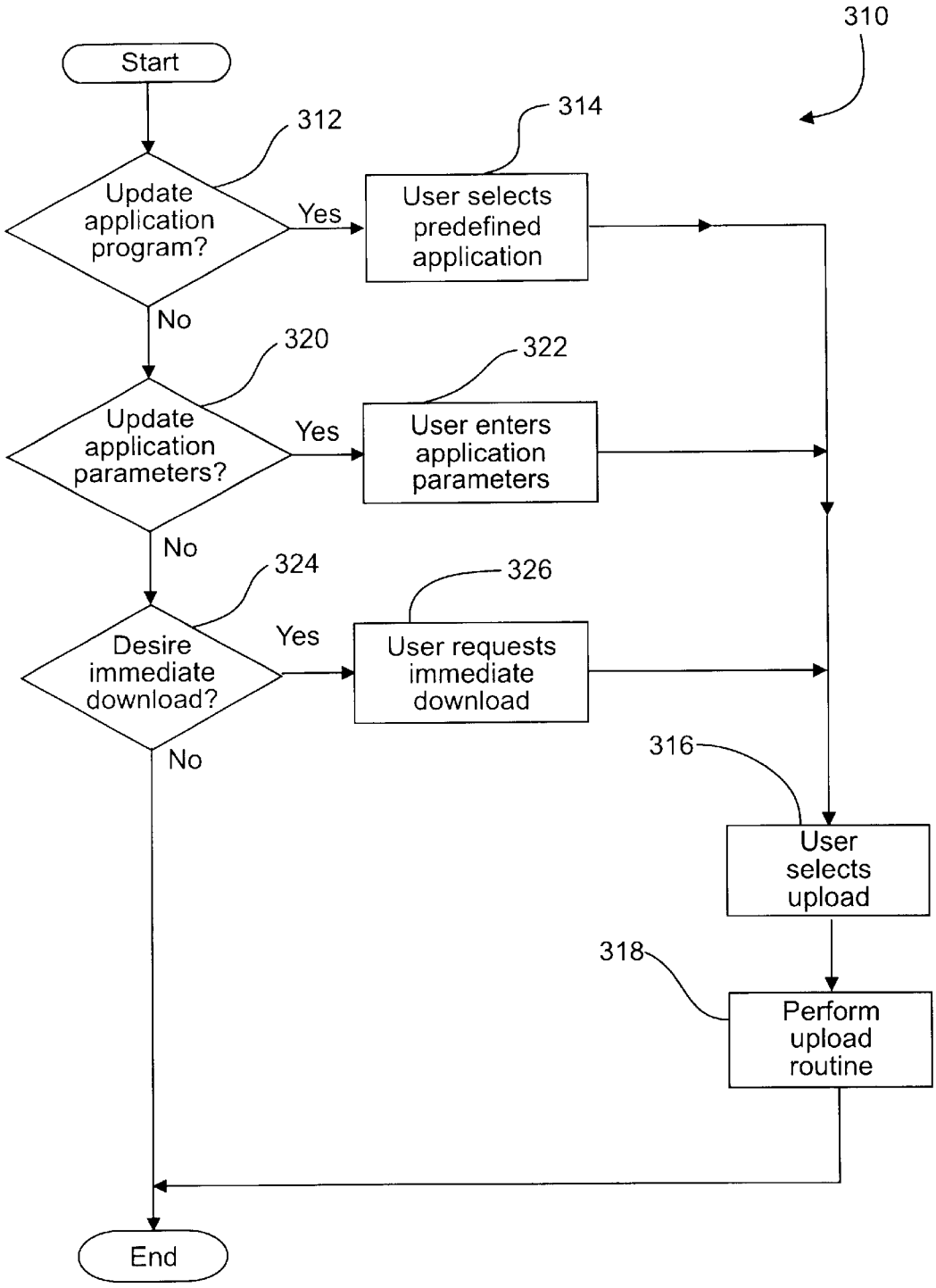
FIG. 7 is a flow chart showing how an end user programs a remote mobile unit.

A user interface is provided which allows uploading application software to a remote mobile unit. This process 310 is illustrated in the flow chart of FIG. 7. The user may typically request three different operations. First, an application program (either new or replacement) may be uploaded to a remote mobile unit. Each application program is designed to operate with a specific sensor attached to the mobile unit. If the user desires an update to the application program, step 312, an appropriate, predefined application program is selected, step 314. An upload is initiated by the user, step 316 and the application program is uploaded to the remote mobile unit, step 318. This uploading process has been described in detail hereinabove. Once uploaded, the selected application software is executed in accordance with the specifics of the uploaded software. Only application software suitable for and compatible with a particular remote sensor may be uploaded.

The following is a typical example of an application software upload. A particular sensor "n" is identified as having the capability to sample heart rate and to measure EKG activity. For this sensor "n", application software which continuously samples heart rate of the wearer is selected. When the wearer's heart rate exceeds 150 beats per minute, the application software initiates a five second, high frequency EKG sample. Upon completion of the EKG trace, heart rate sampling is restarted. Data is transferred to the base unit every five minutes.

Another function of the user interface allows the end user to change the operating parameters of application software already executing with a specific sensor at the remote mobile unit. If parameter update is requested, step 320, new parameters are entered, step 322. The new parameters may be either directly entered or one of a predetermined set of parameters may be selected. Once parameters are entered, the user initiates an upload, step 316 and the new parameters are uploaded, step 318. The application software accepts the new parameters and modifies its behavior accordingly.

In the previous example, a heart rate threshold of 150 beats per minute (bpm) was selected to trigger a five second EKG reading. Typical changes to the parameters could be to change the threshold to 120 bpm and/or change the EKG sample time from five seconds to ten seconds. It should be obvious that wide range of parameter changes suitable for each specific sensor type could be made.

A third function of the user interface allows an end user to request an immediate download of data from a selected remote sensor, step 324. If immediate download is desired, step 324, immediate sensor data download is requested, step 326, generally over-riding the application software which is currently executing for the remote sensor. An upload operation is initiated, step 316 and the immediate data download request is uploaded to the remote mobile unit, step 318.

Figure 8:
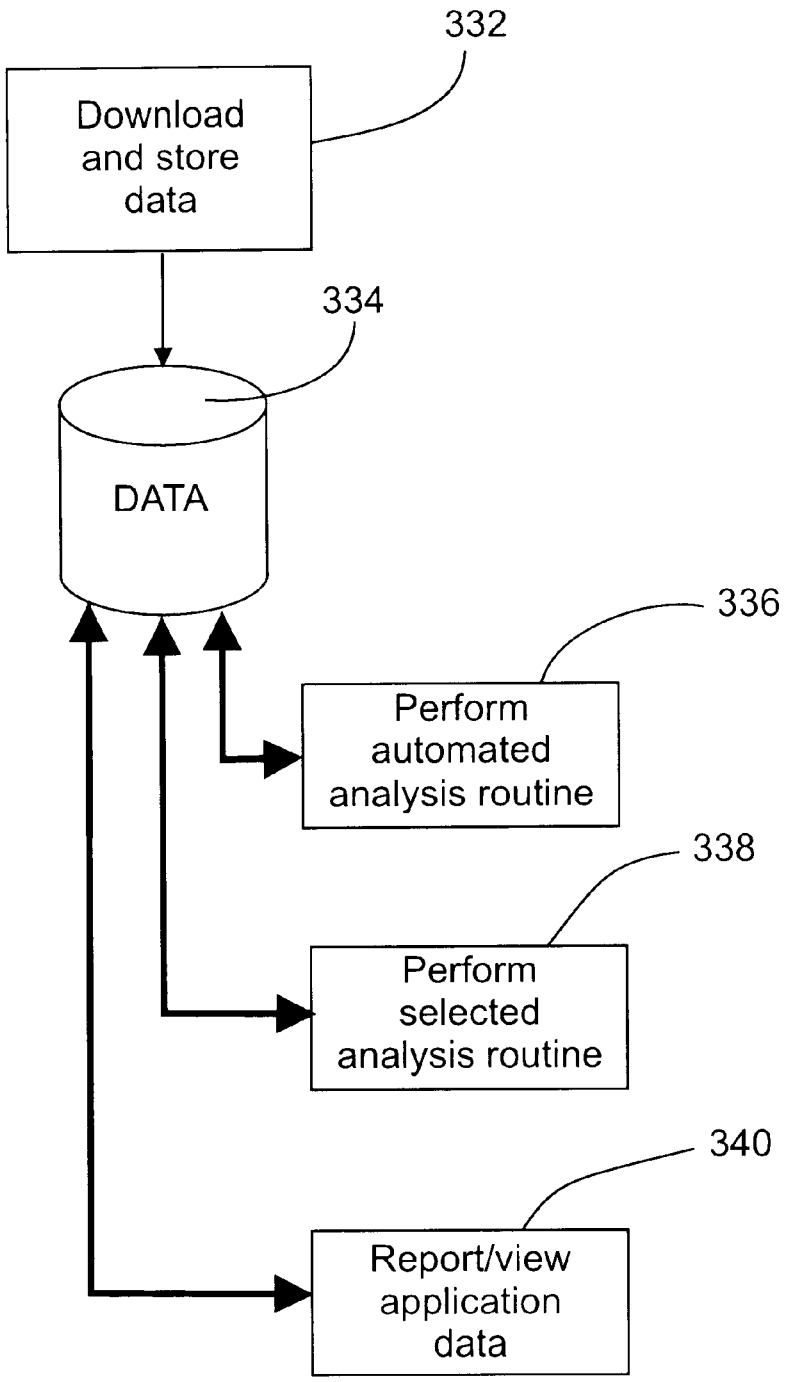
FIG. 8 is a flow chart of the data analysis process.

Referring now to FIG. 8, there is shown a flow chart illustrating the data analysis and reporting capabilities of the inventive remote sensor system. Data is downloaded and stored, step 332 as has been described in detail hereinabove. Data 334 is then available for automated data analysis, step 336, manually selected data analysis, step 338, and/or viewing and reporting, step 340.

An example of automated data analysis, step 336 may be applied to the previously provided example. If a particular sensor is measuring and reporting the heart rate of a wearer, the automated analysis routine could report statistics such as minimum heart rate, maximum heart rate as well as cumulative hourly, and/or daily heartbeats of the wearer. This type of data analysis is programmed into the user interface.

The user interface also allows the user to select from one or more predetermined data analysis routines, step 338. For example, if data is available from a sensor capable of providing EKG traces, the user could select a data analysis routine to detect certain cardiac conditions from the EKG data. Upon completion of the analysis, the user interface reports the results to the user.

Finally, the user interface provide a facility to report and/or view the sensor data, step 340. A user can select from a variety of data formats such as "raw data", charts, tables, etc. The data may be selected from multiple sensors and/or multiple remote mobile units in accordance with predefined rules.

It is to be understood that the present invention is not limited to the embodiments described above, but encompasses any and all embodiments within the scope of the following claims.

What is claimed is:

1. A multi-sensor, reconfigurable, programmable remote sensing system, comprising:

a) a remote mobile unit comprising a first radio frequency data transceiver adapted for transmitting sensor data and receiving commands, a microprocessor and signal collection means, said remote mobile unit being adapted to connect to and accept data from a plurality of diverse, interchangeable sensors, each sensor being equipped with a standard interface for pluggable connection to said signal collection means;

wherein each of said plurality of diverse, interchangeable sensors provides an output in a predetermined output level range, wherein at least one of said plurality of diverse, interchangeable sensors further comprises signal normalization means for modifying a raw output from said at least one sensor to said predetermined output level range, wherein said signal normalization means comprises signal conditioning performed by at least one selected from the group of processes; amplification; attenuation, level converting, phase shifting, integration, differentiation;

b) a base station comprising a second radio frequency data transceiver communicatively compatible with said first radio frequency data transceiver for receiving said sensor data therefrom, said base station further comprising a processor for managing communication with said remote mobile unit and for accepting said sensor data and generating an output representative thereof;

wherein each of said plurality of diverse, interchangeable sensors comprise sensor identification means and at least one of said remote mobile unit and said base station are adapted to interrogate said sensor identification means and at least one of said remote mobile unit and said base station are adapted to interrogate said sensor identification means and perform a configuring operation responsive to a sensor identification retrieved therefrom.

2. The multi-sensor, reconfigurable, programmable remote sensing system as recited in claim 1, wherein said at least one selected signal conditioning process is performed by an active device.

3. The multi-sensor, reconfigurable, programmable remote sensing system as recited in claim 1, wherein said at least one selected signal conditioning process is performed by a passive device.

4. The multi-sensor, reconfigurable, programmable remote sensing system as defined in claim 1, wherein at least one of said plurality of diverse, interchangeable sensors further comprises a plug adapted to mate with a connecter proximate said remote mobile unit and said signal conditioning circuitry is disposed proximate said plug.

5. The multi-sensor, reconfigurable, programmable remote sensing system as recited in claim 1, wherein said sensor identification means comprises a sensor ID chip.

6. The multi-sensor, reconfigurable, programmable remote sensing system as recited in claim 1, wherein said configuring operation is performed automatically in response to a sensor being connected to or disconnected from said remote mobile unit.

7. The multi-sensor, reconfigurable, programmable remote sensing system as recited in claim 1, wherein at least one of said plurality of diverse, interchangeable sensors is pluggably connectable to said remote mobile unit.

8. The multi-sensor, reconfigurable, programmable remote sensing system as recited in claim 1, wherein said remote mobile unit further comprises storage means for temporarily storing output data from at least one of said plurality of sensor when communication between said remote mobile unit and said base station is not possible.

9. The multi-sensor, reconfigurable, programmable remote sensing system as recited in claim 1, wherein said remote mobile unit further comprises storage means for temporarily storing output data from at least one of said plurality of sensor when data is collected from said plurality of sensors at a rate faster than said data can be communicated between said remote mobile unit and said base station.

10. The multi-sensor, reconfigurable, programmable remote sensing system as recited in claim 1, wherein said signal collection means comprises a multiplexor operatively connected to each of said plurality of diverse, interchangeable sensors.

11. The multi-sensor, reconfigurable, programmable remote sensing system as recited in claim 10, wherein said multiplexor comprises an analog-to-digital (A/D convertor.

12. The multi-sensor, reconfigurable, programmable remote sensing system as recited in claim 1, further comprising a sensor-unique application software program for execution on at least one of said remote mobile unit and said base station.

13. The multi-sensor, reconfigurable, programmable remote sensing system as recited in claim 12, wherein at least a portion of said sensor-unique application software program is disabled when an improper sensor is detected.

14. The multi-sensor, reconfigurable, programmable remote sensing system as recited in claim 12, wherein said sensor-unique application software program is uploaded from said base station to said remote mobile unit for execution on said microprocessor of said remote mobile unit.

15. The multi-sensor, reconfigurable, programmable remote sensing system as recited in claim 14, wherein said sensor-unique application software program is automatically uploaded responsive to a sensor being connected to or disconnected from said remote mobile unit.

16. A multi-sensor, reconfigurable, programmable remote sensing system, comprising:

a) a remote mobile unit comprising a first radio frequency data transceiver adapted for transmitting sensor data and receiving commands, a microprocessor and signal collection means, said remote mobile unit being adapted to connect to and accept data from a plurality of diverse, interchangeable sensors, each sensor being equipped with a standard interface for pluggable connection to said signal collection means;

b) a base station comprising a second radio frequency data transceiver communicatively compatible with said first radio frequency data transceiver for receiving said sensor data therefrom, said base station further comprising a processor for managing communication with said remote mobile unit and for accepting said sensor data and generating an output representative thereof, wherein each of said plurality of diverse, interchangeable sensors comprise sensor identification means, and at least one of said remote mobile unit and said base station are adapted to interrogate said sensor identification means and perform a configuring operation responsive to a sensor identification retrieved therefrom.

* * * * *